United States Patent [19]

Ney

[11] Patent Number: 4,638,117

[45] Date of Patent: Jan. 20, 1987

[54] ELECTRICAL CABLE FOR COMMUNICATION PURPOSES

[75] Inventor: Robert Ney, Langerwehe Kreis Düren, Fed. Rep. of Germany

[73] Assignee: Lynenwerk GmbH & Co. Kommanditgesellschaft, Aachen, Fed. Rep. of Germany

[21] Appl. No.: 745,316

[22] Filed: Jun. 14, 1985

[51] Int. Cl.[4] ..... H01B 7/08

[52] U.S. Cl. ..... 174/117 F; 174/112; 174/115; 174/117 R

[58] Field of Search ..... 174/117 R, 117 F, 115, 174/112, 70 R; D13/13

[56] References Cited

U.S. PATENT DOCUMENTS

| | | | |
|---|---|---|---|
| 2,487,064 | 11/1949 | Marsh | 174/112 |
| 2,628,998 | 2/1953 | Frisbie | 174/112 |
| 2,663,755 | 12/1953 | McBride | 174/117 R |
| 2,950,338 | 8/1960 | Taylor | 174/40 R |
| 3,060,260 | 10/1962 | Scofield | 174/117 F |
| 3,458,650 | 7/1969 | Miyawaki et al. | 174/117 F |
| 3,474,189 | 10/1969 | Plate et al. | 174/115 |
| 3,549,788 | 12/1970 | Apen | 174/117 F X |
| 3,600,500 | 8/1971 | Schoerner | 174/115 |
| 3,887,265 | 6/1975 | Margolis et al. | 174/117 F X |
| 3,927,248 | 12/1975 | Scholl et al. | 174/146 X |
| 4,081,602 | 3/1978 | Paniri et al. | 174/117 R X |
| 4,220,812 | 9/1980 | Ney et al. | 174/117 F |
| 4,425,475 | 1/1984 | Ward et al. | 174/117 F |
| 4,467,138 | 8/1984 | Brorein | 174/117 F X |

FOREIGN PATENT DOCUMENTS

| | | | |
|---|---|---|---|
| 481628 | 3/1952 | Canada . | |
| 1004253 | 3/1957 | Fed. Rep. of Germany | 174/117 F |
| 2306386 | 8/1974 | Fed. Rep. of Germany | 174/117 F |
| 2274123 | 2/1976 | France | 174/117 F |
| 414713 | 8/1934 | United Kingdom | 174/115 |

*Primary Examiner*—Arthur T. Grimley
*Assistant Examiner*—Morris H. Nimmo
*Attorney, Agent, or Firm*—Becker & Becker

[57] ABSTRACT

An electrical cable, for communication purposes, having spaced-apart, insulated electrical conductors, between each two of which is disposed a portion having a block-shaped cross section, with a plurality of tension-absorbing elements of high-strength fibers being disposed in this portion. The problem in the past has been that the flexibility of the cable is limited by the specific breaking elongation of the fibers. To resolve this problem, and to improve the flexibility primarily for termination and connection purposes, the cable has an arbitrary number of tension-absorbing elements which are arbitrarily distributed, even in an unsymmetrical manner, in the tension-absorbing block of the cable. The electrical conductors are placed on the bending axis of the cable, which is determined by the tension-absorbing elements, the effect of the conductors on the bending properties, and the casing material. The conductor axis is shifted to such an extent that it coincides with the bending axis which is optimum with regard to the overall system, so that the transverse central planes of the conductors are disposed in the bending axis. This arrangement is also possible for a cable which has more than three parts.

19 Claims, 8 Drawing Figures

FIG-5
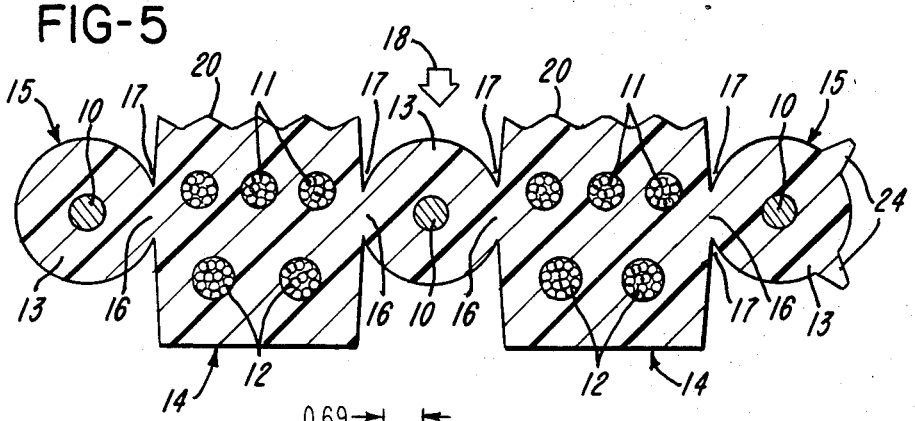
FIG-6
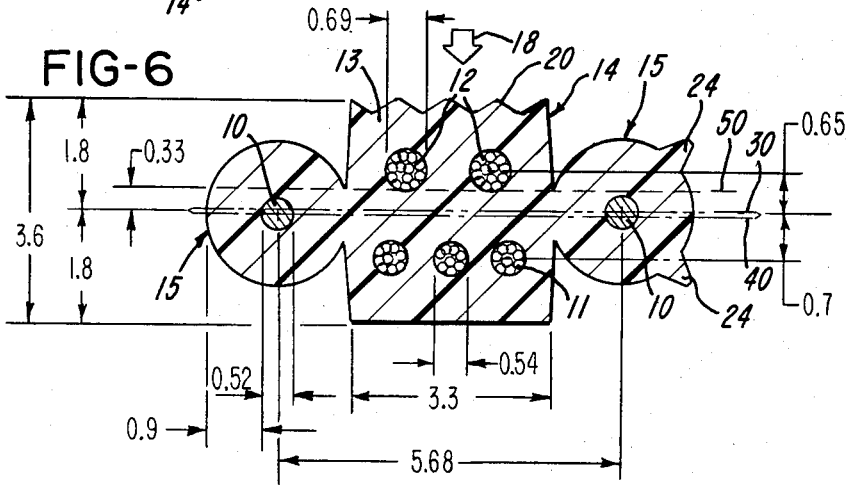
FIG-7
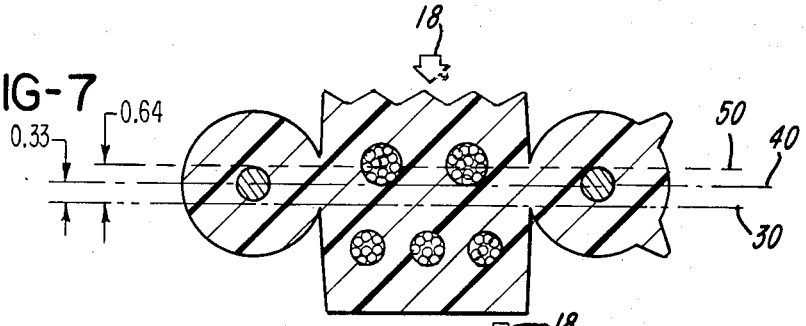
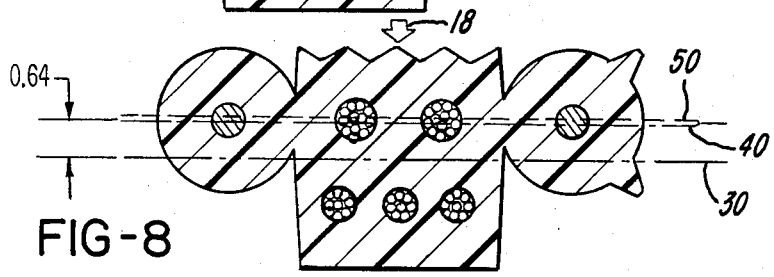
FIG-8

ELECTRICAL CABLE FOR COMMUNICATION PURPOSES

BACKGROUND OF THE INVENTION

1. Field of the Invention

The present invention relates to an electrical cable, for communication purposes, having at least two spaced-apart, insulated electrical conductor means, between each two of which is disposed a portion having a block-shaped cross-section, with a plurality of tension-absorbing elements of high-strength fibers being disposed in each of these portions; the insulation of the conductor means, and the portion for the tension-absorbing elements, are formed by a connecting casing of thermoplastic or elastomeric material in which the conductor means and the tension-absorbing elements are embedded in such a way that they are essentially oriented in the longitudinal direction of the cable parallel to one another; provided between a given one of the portions for the tension-absorbing elements, and an adjoining casing of a conductor means, are longitudinally extending separating grooves, so that the cable has an at least three-part cross-sectional shape.

2. Description of the Prior Art

A cable of this general type is known from U.S. Pat. No. 4,220,812—Ney et al., issued Sept. 2, 1980 to the assignee of the present application. In this known cable, the tension-absorbing elements are symmetrically disposed in pairs in the block-shaped central portion of the cable; this is supposed to produce a uniform flexibility in the two main directions of the cable. The bending axis apparently coincides with the imaginary connecting line between the electrical conductors. This also leads to a symmetrical configuration of the entire cable cross-section.

Similar electrical cables having symmetrical cross-sectional shapes are shown in U.S. Pat. Nos. 2,950,338 (Taylor), 2,628,998 (Frisbie), 2,663,755 (McBride), 3,060,260 (Scofield), 3,458,650 (Miyawaki et al), 3,549,788 (Apen et al), 3,927,248 (Schöll), and the aforementioned U.S. Pat. No. 4,220,812 (Ney et al); in the Canadian Pat. No. 481,628 (Witthoft); in the British Pat. No. 414,713 (Pirelli); in the French Patent application No. 22 74 123 (Thomson-Brandt); in German Offenlegungsschrift No. 23 06 386 (Kubelwerk Wagner); and in German Auslegeschrift No. 10 04 253 (Höhn).

Most of these heretofore known cables contain only a single load-carrying element or tension-absorbing element in the form of a thin, flexible steel cable which is encased with the same material as is the electrical conductor of the cable. Cables of this type are also known which have two stranded wires embedded in the casing. Only the aforementioned U.S. Pat. No. 4,220,812 (Ney) has a greater number of tension-absorbing elements, with these elements comprising fibers of glass or graphite. With all of the heretofore known cables, the bending property is uniform at right angles to the longitudinal central plane of the cable due to its symmetrical configuration. However, as a result these known cables cannot always satisfy certain requirements when the cables are being laid. Although the bending is well controlled when the cable is suspended between poles or buildings, the small bending radii required in conjunction with termination of the wire can often not be achieved, or lead to damage of the cable, which initially cannot even be recognized. The bending properties are also significant with regard to connecting the cables.

The requirements cannot be optimally fulfilled with the heretofore known constructions.

An object of the present invention is to provide an electrical cable of the aforementioned general type which has selected bending properties with which it can conform to the particular requirements for termination and connection without adversely affecting the tensile strength of the cable in the field of termination for example when rigged between poles. In other words, the flexibility of the cable is to be improved by structural measures. In so doing, the cable should be capable of being produced in a simple manner without significant alteration of the customary manufacturing equipment.

BRIEF DESCRIPTION OF THE DRAWINGS

These objects, and other objects and advantages of the present invention, will appear more clearly from the following specification in conjunction with the accompanying drawings, in which:

FIG. 5 is a schematic illustration showing the cross-sectional surface of a five-part embodiment of the inventive cable having three electrical conductors and two tension-absorbing blocks, each of which contains five tension-absorbing elements; and FIGS. 6 to 8 are schematic illustrations of the cross-sectional surface of an inventive cable showing the features for optimizing the flexibility of the cable; in order to clearly show the relative dimensions, FIG. 6 is provided with dimensions, in millimeters.

SUMMARY OF THE INVENTION

Figure 1:
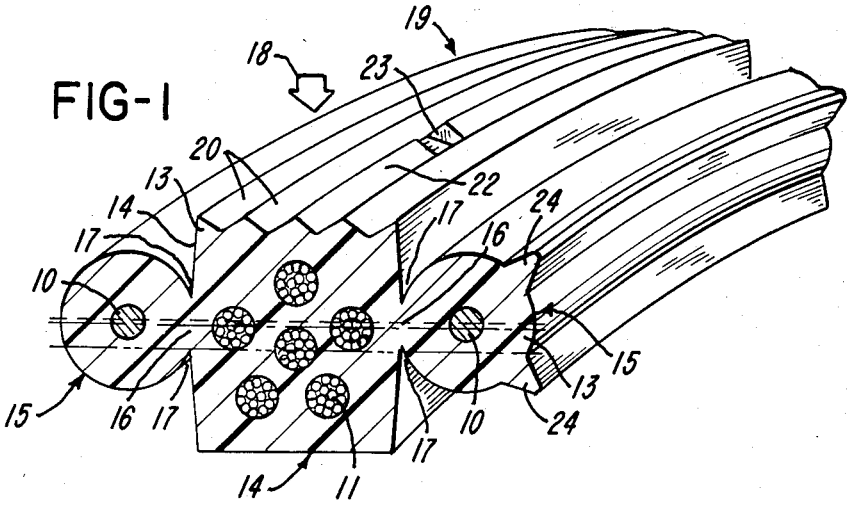
FIG. 1 is a perspective view showing a cross-sectional surface of a bent cable pursuant to one embodiment of the invention, which has two electrical conductors and six tension-absorbing elements.
Figure 2:
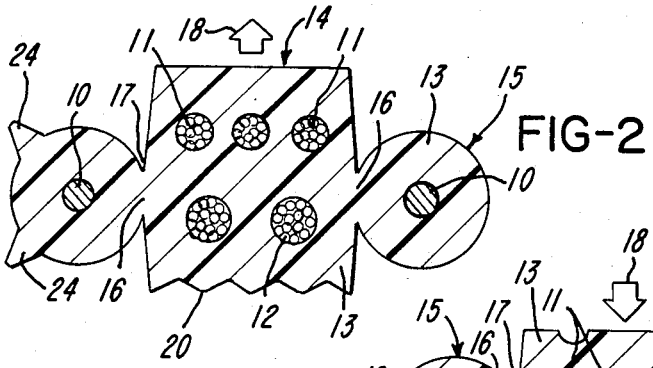
FIG. 2 is a schematic illustration showing the cross-sectional surface of another embodiment of an inventive cable having two conductors and five tension-absorbing elements of different sizes.

The electrical cable of the present invention is characterized primarily in that an arbitrary number of tension-absorbing elements are arbitrarily distributed in the block-shaped portions; furthermore, the electrical conductor means are placed on the bending axis of the cable, which is determined by the tension-absorbing elements, the effect of the conductor means on the bending properties, and the casing material; an imaginary line, which connects the conductor means, is displaced to such an extent that it coincides with the bending axis which is optimum for the cable, so that the transverse central planes of the conductor means are disposed in the bending axis; bridges of the casing material are respectively formed between a given block-shaped portion and an adjoining casing of a conductor means at the location of the separating grooves, the depth of which is such that the bridges of material are uniformly aligned with the optimum bending axis, i.e.

are centrally disposed over the imaginary line which connects the conductor means.

The approach of the present invention can be used not only for three-part communication cables, but also for cables having more than three parts, for example five-part cables. Whereas with three-part cables there is disposed between the two electrical conductors, which are in the form of wires or conductor bundles, a central block-shaped portion in which are disposed the tension-absorbing elements, with, for example, a five-part cable three conductor means in the form of wires or bundles are provided, namely two on the outer sides of the cables and one in the center, with a respective block-shaped portion with its tension-absorbing elements being disposed between each outer conductor means and the centrally disposed conductor means. The block-shaped portions, in which are disposed the tension-absorbing elements, can also be designated as tension-absorbing blocks or tension relief blocks.

Pursuant to advantageous further features of the present invention, the tension-absorbing elements may be disposed either unsymmetrically or symmetrically in a given block-shaped portion. Within a given block, either individual tension-absorbing elements or groups of these elements may have different thicknesses. The number of tension-absorbing elements may be greater in that part of a given block-shaped portion which is subjected to tension than the number of such elements in that cross-sectional part of the portion which is subjected to compression. Alternatively, the sum of the cross-sections of the tension-absorbing elements in that cross-sectional part of a given block-shaped portion which is subjected to tension may be greater than the cross-sections of the elements in that part of this portion which is subjected to compression.

The entire group of tension-absorbing elements in a given block-shaped portion may be eccentrically disposed to the axis of symmetry of this portion whereas the electrical conductor or bundle which is adjacent to this portion, along with their casings and material bridges, are centrally disposed in that the connecting line between the conductors or bundles is aligned with the symmetrically extending transverse axis of the cable.

That surface of the cable which is on the outside and is convexly curved when the cable is bent about its longitudinal axis, may be provided with a marking, for example in the form of at least one endless longitudinal groove. This longitudinal groove or grooves may be provided with interruptions, i.e. may be dotted, and at the same time may represent a linear measurement. The surface of the casing may be provided with such a number of parallel longitudinal grooves that the entire surface is covered therewith.

As previously mentioned, the tension-absorbing elements may comprise bundles of glass fibers, or graphite fibers. In addition, they may comprise threads of aromatic polyamide. The encasing material may comprise high-density polyethylene, and the tension-absorbing elements may be embedded in this material in an undulating fashion.

One of the outwardly disposed casings for the conductor means may, when viewed in cross-section, be provided with at least one orientation projection.

The present invention proceeds from the recognition of the fact that with a symmetrical cross-sectional configuration of a cable, the bending axis of the latter only appears to coincide with the cable symmetry axis, which extends in the transverse direction, whereas in reality this bending axis extends parallel to, and at a distance from, this axis of symmetry, and in particular in the opposite direction to the direction of bending. The main reason for this is that the tension-absorbing elements which are used have a specific breaking elongation of approximately 2 percent, so that when the cable bends, along with the tension load of the elements connected therewith, the elongation can also not be greater than 2 percent. This corresponds to a specific bending radius of the cable. However, as often occurs when the cable is being laid and connected, the cable is bent about a smaller radius, the bending axis in the cable cross-section is displaced toward the tension-absorbing elements, which during this bending are subjected to tension. The tension stressing of the tension-absorbing elements thus increases and can lead to damage, and even possibly to breaking of individual tension-absorbing elements or fibers if, for example, the cable is kinked during such a bending process. In this connection, it must be borne in mind that for the bending behavior only those tension-absorbing elements and other conponents of the cable are important which during the bending have to absorb tension forces, whereas those elements disposed on that side of the cable cross-section which is subjected to compression forces are disregarded because, as fibers or yarns, they absorb no compression forces and thus cannot be compressed.

The flexibility of the cable is optimized pursuant to the present invention, and thus there is avoided the danger of damaging the tension-absorbing elements, which damage is generally not even noticed due to the small size of the system.

Starting with the known breaking elongation of the tension-absorbing elements, which are subjected to tension when the cable is bent, and from further parameters, the displacement of the bending axis of the cable can be calculated. When this is done, and the position of the bending axis is known, it is not sufficient to merely shift the imaginary connecting line between the electrical conductors or bundles and to place it upon the calculated bending axis, so that both of the lines coincide. Rather, a repeated shifting of the bending axis is undertaken accompanied by a follow-on adjustment of the aforementioned connecting line or conductor axis in order to obtain an optimum position of these axes, and hence to achieve an appropriately favorable cable cross-section. In this connection, it must be taken into account that the bending properties of the cable result not only from the mechanical properties of the tension-absorbing elements, but also from the mechanical properties of the electrical conductor means, and to a lesser extent are also influenced by the casing material. The inventive approach teaches that the imaginary line which connects the electrical conductor means is to be shifted to such a extent that it coincides with that bending axis which is optimum as regards the overall system. This would not be possible if the conductor axis were merely moved as far as the bending axis which was determined by the first calculation. The latter appears to provide only an improved construction of the cable.

The approach pursuant to the present invention permits a plurality of possibilities for the configuration of the cable cross-section, in other words, for the pattern of disposing the tension-absorbing elements in the tension-absorbing block of the cable. Whereas pursuant to the state of the art it was always necessary to have a symmetrical arrangement, because it was thought that only in this way could a proper bending property be assured, it is possible pursuant to the present invention to achieve an individual bending property by also providing an unsymmetrical arrangement of the tension-absorbing elements, which even has certain advantages. However, it is not only various patterns for the arrangement of the tension-absorbing elements which bring about these advantages, but it is also possible pursuant to the present invention to utilize different cross-sectional sizes for the tension-absorbing elements, thus resulting in a greater degree of unsymmetry, which under certain conditions permits an optimization of the bending axis. Although the displacement of the connecting line between the conductors (the conductor axis) in the direction of the bending axis fundamentally implies that the electrical conductors with their insulation are attached to the tension-receiving block at a location shifted in the opposite direction relative to the bending direction, the inventive teaching of the optimum bending axis also permits the conductor axis to remain in the plane of symmetry of the tension-absorbing block, so that from the outside the pertaining cable does not look any different, although its bending properties are significantly improved.

In most cases the result of the inventive approach is that the cable has a preferred bending direction, i.e. a specific bending direction which permits particularly small bending radii to be achieved, while the possibility of bending in the other direction cannot achieve this degree. This plays an important role for termination and connection. So that the assembly personnel can immediately recognize which is the preferred bending direction of the cable, it is recommended pursuant to the present invention to provide that surface of the casing of the cable which is convexly curved and outwardly disposed when the cable is bent, with the aforementioned marking, which can, for example, be in the form of parallel, longitudinal grooves which can not only be recognized with the eye but can also be felt with the fingers.

DESCRIPTION OF PREFERRED EMBODIMENTS

Figure 3:
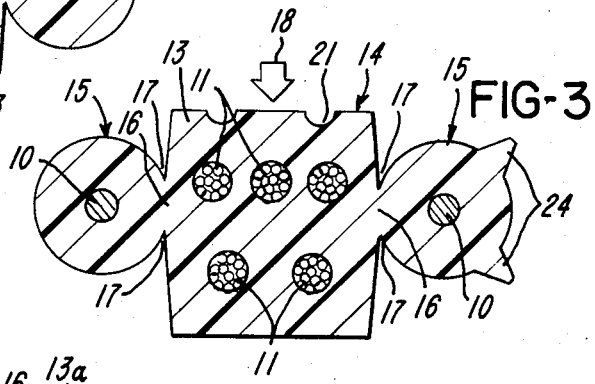
FIG. 3 is a schematic illustration showing the cross-sectional surface of yet another embodiment of an inventive cable having five tension-absorbing elements of the same size.
Figure 4:
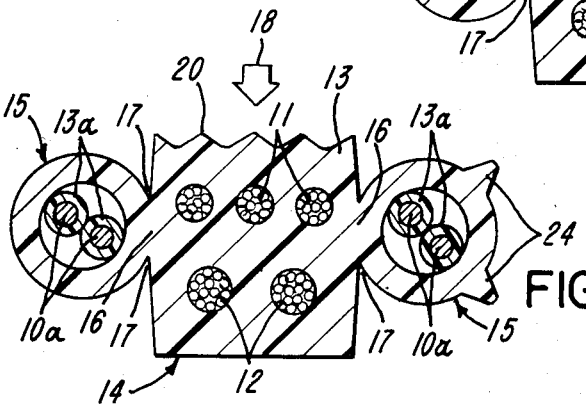
FIG. 4 is a schematic illustration showing the cross-sectional surface of a further embodiment of an inventive cable having two bundles of insulated electrical conductors, and five tension-absorbing elements of different sizes.

Referring now to the drawings in detail, the illustrated inventive electrical communication cable, which is also known as a drop wire, includes two or three electrical conductors 10, which can also be referred to either as wires or, pursuant to FIG. 4, as two bundles each comprising two stranded, insulated electrical conductors 10*a* having insulation 13*a*; the inventive cable furthermore includes a number of tension-absorbing elements 11, 12, which are formed by a bundle of filaments of glass fibers, as well as the material 13, for example polyvinyl chloride, which encases, embeds, and at the same time insulates in common the conductors 10 and the tension-absorbing elements 11, 12. The material 13 is extruded, thus resulting in the cross-sectional shape of the cable which is visible in the drawings. In the embodiments illustrated in FIGS. 1–4 and 6–8, the cable has a three-part cross-section, whereas in FIG. 5 it has a five-part cross-section. These parts comprise block-shaped portions 14, also known as tension-absorbing blocks, and essentially round sheathings 15 for the conductors 10. For optical reasons, the parts 15 can also be known as "ears". The material of the ears 15 merges integrally, without a seam, into the material of the tension-absorbing block 14, as a result of which bridges 16 of material are produced between the parts 14 and 15. Due to the round cross-sectional shape of the ears 15, two separating grooves 17 exist on each side on both sides of the material bridges 16 between the parts 14 and 15; all of the grooves 17 have the same shape. Due to these separating grooves 17, the top and bottom of the tension-absorbing block 14 is somewhat narrower than it is in its transverse center. As a result, the block 14 appears to have a six-sided shape.

In the drawings, the preferred bending direction of the electrical cable is in each case indicated by an arrow 18. It is clear in each embodiment that the cable is provided on its outwardly disposed, convexly curved surface of the tension-absorbing block 14 with an optically recognizable marking 19 which can also be felt with the fingers. Pursuant to the illustrated embodiments, this marking 19 is either in the form of longitudinal grooves 20 which cover the entire surface of the tension-absorbing block 14, or, in the case of the embodiment of FIG. 3, is in the form of two parallel rounded grooves 21. As can furthermore be seen from FIG. 1, the central rib 22, for example, of the grooves 20 can be provided at certain intervals with an interruption or broken-away portion 23 in order to provide the cable with an easily legible linear measurement in inches or meters. In order to recognize the orientation of the cable—right and left—one of the ears 15 has formed thereon projections 24.

For the purpose of termination and connection, when the cable is being laid it is bent relatively substantially in the direction of the arrow 18, whereby the ears 15 with the wires 10 or bundles 10*a* are separated from the tension-absorbing block 14 in that the bridges 16 of material are first scored in the longitudinal direction of the cable, and are then torn away by hand. This is done along a length needed by the user in order to be able to expediently connect the conductor 10. The separating grooves 17 are of such a depth that on the one hand the material bridges 16 can be easily severed, yet on the other hand still assure a reliable connection of the cable until it is separated.

As can be seen from the drawings, various numbers of tension-absorbing elements 11, 12 are disposed in the individual tension-absorbing blocks 14, with the tension-absorbing elements being disposed in various patterns. These patterns show an unsymmetrical arrangement of the tension-absorbing elements relative to the transverse center line of the respective cable cross-sections. The tension-absorbing elements 11 can either be of a uniform thickness, as in the embodiments of FIGS. 1 and 3, or can have different thicknesses, as shown by the thicker tension-absorbing elements 12 in the embodiments of FIGS. 2, 4, and 5.

FIGS. 6–8 illustrate in principle how to optimize the bending capability of the cable. For this purpose, these Figures show three imaginary axes, which extend transversely over the cross-section of the cable and are necessary for describing the procedure when optimizing the bending capability. These axes include the axis of symmetry 30 of the tension-absorbing block 14, the conductor axis 40 which represents the connecting line between the electrical conductors 10, and the bending axis 50 which is established during the preferred bending in the direction of the arrow 18 due to the prescribed breaking elongation of the tension-absorbing elements 11, 12. In particular the bending axis 50 and the conductor axis 40 are of crucial significance within the framework of this discussion. The axis of symmetry 30 is shown by a dash-double-dot line, the conductor axis 40 is shown by a dot-dash line, and the bending axis 50 is shown by a dashed line.

During the construction of the cable, the starting point is a symmetrical cross-section of the encasing material 13; in other words, the central block-shaped portion 14 has a symmetrical shape, and symmetrically supports at both sides the ears 15. In this situation, the axis of symmetry 30 and the conductor axis 40 coincide, i.e. these two axes are aligned with one another. However, the bending axis 50 does not coincide with the axes 30 and 40, but rather shifts upwardly by a calculable amount during bending in the direction of the arrow 18, as indicated in FIG. 6. The amount of displacement is essentially a function of the number of tension-absorbing elements in that region of the tension-absorbing block 14 which undergoes tension, as well as the distance of these tension-absorbing elements from the axis of symmetry 30. Also entering into the calculation are the modulus of elasticity of the conductors 10, of the glass filaments of the tensioning absorbing elements 11, 12, and of the encasing material 13, as well as the number of glass filaments per bundle. The result is the distance of the bending axis 50 from the axis of symmetry 30, with the latter coinciding with the conductor axis 40 in FIG. 6.

To optimize the bending property of the cable, the conductor axis 40 is now placed upon the bending axis 50, so that the conductor axis 40 is spaced at a distance above the axis of symmetry 30. At the same time, the ears 15 are also displaced upwardly. However, in so doing the position of the bending axis 50 is not stabilized; rather, it moves further upwardly because it continuously mirrors the bending property of the overall system, which means that the conductor axis 40 must again follow. This occurs structurally until the conductor axis 40 has finally to a certain extent caught up (so-called iteration or successive approximation) with the bending axis 50, and in an optimum approximation is disposed so close to the bending axis 50 that one can say that the two axes 40 and 50 coincide with one another. When this state is achieved, the cable has an optimum bending characteristic in the preferred direction of bending shown by the arrow 18.

Whereas FIG. 6 illustrates the starting situation, FIG. 7 shows the displacement of the conductor axis 40 as far as the bending axis 50, and FIG. 8 finally shows the optimum state, i.e. the again upwardly shifted bending axis 50 and the conductor axis 40 which has followed it. This signifies at the same time that the bridges 16 of material at the tension-absorbing block 14 constantly move further upwardly along with the conductor axis 40.

In order to avoid an outer shape of the cable which is too unsymmetrical, i.e. ears 15 which are connected to the tension-absorbing block 14 too far to the top, an opposite effect can be produced by shifting the tension-absorbing elements 11, 12 in the block 14 in the direction of the arrow 18, in other words, downwardly in the drawing, so that the bending axis 50 shifts toward the conductor axis 40 until these two axes again coincide with one another. In this manner, the ears 15 can again be connected more in the transverse center of the tension-absorbing block 14. A suitable measure in order in this respect to achieve an optimizing of the conditions can comprise selecting tension-absorbing elements of sufficient diameters, as illustrated for example in the embodiments of FIGS. 2, 4, and 5, where tension-absorbing elements of differing diameters are provided. However, the number and position of the tension-absorbing elements can also bring about that the bending axis 50 does not shift so far upwardly, so that also the conductor axis 40, and hence the ears 15, remain more in the transverse middle of the cable. Once one has become familiar with the principle of this shifting of the axes, many desired shapes can be implemented. The important thing is that the conductor axis 40 not be placed only one time upon the bending axis 50; rather, it must be taken into account that the bending axis depends upon the configuration of the overall system, so that the conductor axis continuously follows in order to achieve an optimum result.

Since in principle the bending property is dependent in both directions, i.e. in the direction of the arrow 18 and in the opposite direction, from the number, arrangement, and thickness of the tension-absorbing elements 11, 12 in the block 14, the bending property can also be optimized in the direction counter to the arrow 18. In particular, this can be accomplished at least in regard to the outer symmetry of the cable, for example by placing the conductor axis 40 upon the bending axis 50, whereby the latter extends above the axis of symmetry 30, and by at the same time placing the non-illustrated bending axis in the direction counter to the arrow 18 upon the axis of symmetry 30. However, for this purpose, as previously mentioned an eccentric arrangement of the pattern of the tension-absorbing elements in the block 14 in the direction of the arrow 18 is required, with this eccentricity being undertaken in the extreme case to such an extent that the outer shape of the cable is again completely symmetrical, i.e. the conductor axis 40 then again coincides with the axis of symmetry 30, and the two axes are aligned with the bending axis 50.

Preferred and hence optimum bending properties can be incorporated into electrical communication cables of this type as a consequence of the unsymmetrical number, size, and arrangement of the tension-absorbing elements 11, 12. Practically all possible requirements for termination and connection, even in particularly difficult situations, can be fulfilled.

The present invention is, of course, in no way restricted to the specific disclosure of the specification and drawings, but also encompasses any modifications within the scope of the appended claims.

What I claim is:

1. An electrical cable, for communication purposes, having at least two spaced-apart, insulated electrical conductor means, between which is disposed a portion having a block-shaped cross-section, with a plurality of tension-absorbing elements of high-strength fibers being disposed in said block-shaped portion; the insulation of said conductor means, and said block-shaped portion, being formed by a connecting casing of thermoplastic or elastomeric material in which said conductor means and said tension-absorbing elements are embedded in such a way that they are essentially oriented in the longitudinal direction of said cable parallel to one another; and provided between a given block-shaped portion and an adjoining casing of a conductor means, are longitudinally extending separating grooves, so that said cable has an at least three-part cross-sectional configuration;

the improvement comprising a number of said tension-absorbing elements, which are distributed in said block-shaped portion; said conductor means are placed on the bending axis of said cable, which is determined by said tension-absorbing elements, by the effect of said conductor means on the bending properties, and by said casing material; an imaginary line, which connects said conductor means, is displaced to such an extent that it coincides with the bending axis which is optimum for said cable, so that the transverse central planes of said conductor means are disposed in said bending axis; bridges of said casing material are respectively formed between a given block-shaped portion and an adjoining casing of a conductor means at the location of said separating grooves, with the depth of the latter being such that said bridges of material are uniformly aligned with said optimum bending axis, i.e. are centrally disposed over said imaginary line which connects said conductor means; said tension-absorbing elements being disposed in said block-shaped portions in an unsymmetrical manner.

2. An electrical cable according to claim 1, in which each of said conductor means is a conductor wire.

3. An electrical cable according to claim 1, in which each of said conductor means is a bundle of at least two insulated, stranded conductors.

4. An electrical cable according to claim 1, which includes at least three said conductor means and at least two said block-shaped portions, so that said cable has an at least five-part cross-sectional configuration.

5. An electrical cable according to claim 1, in which, in one of said block-shaped portion, the thickness of at least one of said tension-absorbing elements is different from the rest.

6. An electrical cable according to claim 1, in which one of said block-shaped portion has a first cross-sectional part which is subjected to tension, and a second cross-sectional part which is subjected to compression, with the number of said tension-absorbing elements in said first part being greater than the number of said tension-absorbing elements in said second part.

7. An electrical cable according to claim 1, in which one of said block-shaped portion has a first cross-sectional part which is subjected to tension, and a second cross-sectional part which is subjected to compression, with the sum of the cross-sectional areas of said tension-absorbing elements in said first part being greater than the sum of the cross-sectional areas of said tension-absorbing elements in said second part.

8. An electrical cable according to claim 1, in which the tension-absorbing elements of one of said block-shaped portion, when taken as a group, are eccentrically disposed relative to the axis of symmetry of said block-shaped portion itself; and in which the adjacent electrical conductor means, along with their casings and bridges of material, are centrally disposed in that the connecting line between said conductor means is aligned with the symmetrically extending transverse axis of said cable.

9. An electrical cable according to claim 1, in which that surface of said casing which is convexly curved and faces outwardly when said cable is curved about its longitudinal axis, is provided with a marking.

10. An electrical cable according to claim 9, in which said marking comprises at least one longitudinally extending groove.

11. An electrical cable according to claim 10, in which said at least one longitudinal groove is continuous.

12. An electrical cable according to claim 11, in which at least one of said at least one longitudinal groove is provided with interruption for the representation of a linear measurement.

13. An electrical cable according to claim 11, in which said convexly curved surface is provided with a number of parallel longitudinal grooves that it is entirely covered with grooves.

14. An electrical cable according to claim 1, in which said tension-absorbing elements comprise bundles of glass fibers.

15. An electrical cable according to claim 1, in which said tension-absorbing elements comprise graphite fibers.

16. An electrical cable according to claim 1, in which said tension-absorbing elements comprise threads of aromatic polyamide.

17. An electrical cable according to claim 1, in which said casing material comprises high-density polyethylene.

18. An electrical cable according to claim 1, in which said tension-absorbing elements are embedded in said casing material in an undulating manner.

19. An electrical cable according to claim 1, in which one of the outwardly disposed casings of said conductor means, when viewed in the transverse direction of said cable, is provided with at least one orientation projection.

* * * * *